US008307921B2

(12) United States Patent
Eddison

(10) Patent No.: US 8,307,921 B2
(45) Date of Patent: Nov. 13, 2012

(54) DRILLING APPARATUS

(75) Inventor: Alan Martyn Eddison, Aberdeen (GB)

(73) Assignee: National Oilwell Varco, L.P., Houston, TX (US)

( * ) Notice: Subject to any disclaimer, the term of this patent is extended or adjusted under 35 U.S.C. 154(b) by 332 days.

(21) Appl. No.: 12/663,444

(22) PCT Filed: Jun. 5, 2008

(86) PCT No.: PCT/GB2008/001930

§ 371 (c)(1),
(2), (4) Date: Feb. 16, 2010

(87) PCT Pub. No.: WO2008/149098

PCT Pub. Date: Dec. 11, 2008

(65) Prior Publication Data

US 2010/0181115 A1 Jul. 22, 2010

(30) Foreign Application Priority Data

Jun. 7, 2007 (GB) ..... 0710891.3

(51) Int. Cl.
*E21B 10/26* (2006.01)

(52) U.S. Cl. ..... 175/385

(58) Field of Classification Search ..... 175/386, 175/391, 392, 385

See application file for complete search history.

(56) References Cited

U.S. PATENT DOCUMENTS

| | | | | |
|---|---|---|---|---|
| 1,302,058 | A * | 4/1919 | Layne | 175/229 |
| 1,391,626 | A * | 9/1921 | Gilthorpe | 175/98 |
| 1,902,174 | A | 3/1933 | Lewis | |
| 2,122,863 | A * | 7/1938 | Howard et al. | 175/347 |
| 2,179,010 | A | 11/1939 | Creighton et al. | |
| 2,890,022 | A | 6/1959 | Brown, Jr. | |
| 3,376,942 | A | 4/1968 | Van Winkle | |
| 3,429,387 | A | 2/1969 | Brown | |
| 3,431,989 | A | 3/1969 | Waterman et al. | |

(Continued)

FOREIGN PATENT DOCUMENTS

FR 1249499 A 12/1960

(Continued)

OTHER PUBLICATIONS

International Search Report and Written Opinion for PCT/GB2008/001930.

UK Patent Office, Examination Report, Apr. 21, 2011, pp 1-2.

UK Search Report for UK Application GB0710891.3 dated Sep. 6, 2007.

International Preliminary Report on Patentability for PCT/GB2008/001930 dated Dec. 7, 2009.

(Continued)

*Primary Examiner* — Daniel P Stephenson

(74) *Attorney, Agent, or Firm* — Jeffrey E. Daly; JL Salazar Law Firm

(57) ABSTRACT

Drilling apparatus comprises: a body; a pilot hole-drilling assembly (14) mounted to the body for drilling a pilot hole of a first diameter; and a hole-opening assembly (16) mounted to the body for opening the pilot hole to a larger second diameter. The apparatus is configured such that the pilot hole-drilling assembly (14) will drill at a faster rate than the hole-opening assembly (16) for a given unit loading. As the pilot hole-drilling assembly (14) has the capability to drill at a faster rate than the hole-opening assembly (16), the pilot hole-drilling assembly will tend to experience relatively low weight-on-bit (WOB). The pilot hole-drilling assembly (14) will thus tend to maintain a vertical orientation. The hole-opening assembly (16) will follow the path of the pilot hole, while opening the hole to the required diameter.

20 Claims, 1 Drawing Sheet

U.S. PATENT DOCUMENTS

| | | | | |
|---|---|---|---|---|
| 4,031,974 | A | 6/1977 | Peterson | |
| 5,141,062 | A | 8/1992 | Anderson | |
| 6,279,670 | B1 | 8/2001 | Eddison et al. | 175/107 |
| 6,439,318 | B1 | 8/2002 | Eddison et al. | 175/57 |
| 6,508,317 | B2 | 1/2003 | Eddison et al. | 175/107 |
| 7,152,702 | B1 | 12/2006 | Bhome et al. | |
| 2007/0102201 | A1* | 5/2007 | Savignat | 175/385 |
| 2007/0240906 | A1* | 10/2007 | Hill | 175/57 |
| 2010/0116556 | A1* | 5/2010 | Buske | 175/385 |

FOREIGN PATENT DOCUMENTS

| | | |
|---|---|---|
| GB | 2386387 | 9/2003 |
| GB | 2411419 | 8/2005 |
| GB | 2434389 | 7/2007 |
| GB | 2450433 | 12/2008 |
| WO | 02/64939 | 8/2002 |
| WO | 03/008754 | 1/2003 |
| WO | 2004/104360 | 12/2004 |

OTHER PUBLICATIONS

UK Response to 1st Examination Report for UK Application No. GB0921435.4 dated Aug. 24, 2011.

UK 2nd Examination Report for UK Application No. GB0921435.4 dated Dec. 2, 2011.

UK Response to 2nd Examination Report for UK Application No. GB0921435.4 dated Apr. 16, 2012.

UK Div1 Combined Search & Exam Report for UK Application No. GB1204080.4 dated Mar. 29, 2012.

UK Div1 Response to Combined Search & Exam Report for UK Application No. GB 1204080.4 dated May 28, 2012.

UK 3rd Examination Report for UK application No. GB0921435.4 dated Jun. 14, 2012.

UK Div 1 Grant Notification for UK Application No. GB 1204080.4 dated Jul. 10, 2012.

* cited by examiner

DRILLING APPARATUS

FIELD OF THE INVENTION

This invention relates to drilling apparatus, and in particular, but not exclusively, to drilling apparatus for use in drilling vertical hole sections.

BACKGROUND OF THE INVENTION

Holes are drilled in the earth for many reasons, for example, in the oil and gas industry, holes are drilled to access sub-surface hydrocarbon reservoirs. In recent years, in the oil and gas industry the main focus has been on the drilling of "directional" holes or wells. Directional drilling is particularly useful in offshore operations, allowing a large area to be accessed from a single fixed location platform. However, there remains a requirement to drill vertical wells, and there are a number of reasons why accurate vertical drilling may be required. For example, to maximise the number of wells in a seabed template, below which a number of holes may extend, the initial vertical hole sections must be drilled with minimal deviation to maintain anti-collision safety margins. Accurate vertical drilling also facilitates the drilling of "lean" profile wells, where the hole-lining casing diameter is much closer to the open hole diameter, and close tolerance casing strings may be used. Also, even when drilling a deviated hole, accurate vertical drilling is important to minimise deviation and dogleg severity in the initial sections of the well, in order to ensure that when drilling the deeper deviated hole sections the torque and drag does not increase to unacceptable levels. The absence of unnecessary or unintended deviation and doglegs is also important in reducing casing wear due to sucker rod action during subsequent production operations.

At present, accurate vertical drilling relies on use of expensive tools which rely on sophisticated rotary steerable technology.

It is among the objectives of particular embodiments of the present invention to provide a relatively simple drilling apparatus which may be used to provide accurate vertical drilling.

SUMMARY OF THE INVENTION

According to the present invention there is provided a drilling apparatus comprising: a hole-opening bit and a pilot bit mounted on a drill support, in use the pilot bit being suspended from the support.

As the pilot bit is suspended from the drill support, a portion of the drill support will be in tension. This portion will typically be located below the hole-opening bit. The pilot bit may still experience weight on bit, but with at least a portion of the drill support in tension the pilot bit will tend to hang straight and drill a vertical hole.

According to the present invention there is provided a drilling apparatus comprising: a hole-opening bit and a pilot hole-drilling assembly including a pilot bit, the apparatus being configured such that, in use, weight-on-bit at the pilot bit is less than the weight of the pilot hole-drilling assembly.

According to another aspect of the present invention there is provided a method of drilling a subterranean bore, the method comprising: providing a pilot bit and a hole-opening assembly on a drilling support; drilling a pilot hole using the pilot bit; and opening the pilot hole using a hole-opening bit, the pilot bit being suspended from the drilling support.

According to another aspect of the present invention there is provided a method of drilling a subterranean bore, the method comprising: drilling a pilot hole using a pilot bit forming part of a pilot-hole drilling assembly; and opening the pilot hole using a hole-opening bit, the weight-on-bit at the pilot bit being less than the weight of the pilot hole-drilling assembly.

According to the present invention there is provided a drilling apparatus comprising: a pilot hole-drilling assembly; and a hole-opening assembly comprising a hole-opening bit, the apparatus being configured such that, in use, the weight-on-bit at the hole-opening bit includes at least a portion of the weight of the pilot hole-drilling assembly.

According to a first aspect of the present invention there is provided a drilling apparatus comprising: a body; a pilot hole-drilling assembly mounted to the body for drilling a pilot hole of a first diameter and being capable of achieving a rate-of-penetration at a first unit loading; and a hole-opening assembly mounted to the body for opening the pilot hole to a larger second diameter and being capable of achieving the rate-of-penetration at a second unit loading that is greater than the first.

As the pilot hole-drilling assembly is capable of drilling at a lower unit loading than the hole-opening assembly, the pilot hole-drilling assembly will experience a relatively lower weight-on-bit (WOB), and a greater proportion of the weight applied to the apparatus will be borne by the hole-opening assembly. The pilot hole-drilling assembly will thus tend to maintain its orientation. The hole-opening assembly will follow the path of the pilot hole, while opening the hole to the required diameter.

The pilot hole-drilling assembly may be located at the free end of an elongate member extending from the hole-opening assembly. In essence, the pilot hole-drilling assembly is capable of drilling at a faster rate than the hole-opening assembly, so the pilot hole-drilling assembly will tend to experience relatively low WOB, and will thus tend to act as a pendulum, and tend to assume a vertical orientation under the influence of gravity. The pendulum effect may be facilitated or accentuated in a number of ways, for example by one or both of mounting the pilot hole-drilling assembly on a relatively flexible member, or by incorporating high density materials, such as tungsten or a tungsten alloy, in the lower portions of the assembly. Where the pilot hole-drilling assembly is mounted via a relatively flexible member or section, the member or section may be configured to allow a pendulum effect to be achieved, but to avoid buckling. This may be achieved by providing a short flexible section, which may take the form of a knuckle in an upper portion of the pilot hole-drilling assembly.

Achieving a lower unit loading at a given rate-of-penetration for the pilot hole-drilling assembly relative to the hole-opening assembly may be achieved in a number of ways, some of which are described below. The pilot hole-drilling bit may be driven at a faster rate than the hole-opening bit. The pilot bit may be driven by a downhole motor, while the hole-opening bit may be driven solely from surface by rotation of a supporting member, such as a drill string. The downhole motor may be located above the hole-opening bit, this allowing a relatively large and powerful motor to be provided, as the power section of the motor may be accommodated in the relatively large diameter bore cut by the hole-opening bit. Alternatively, the motor may be provided below the hole-opening bit, within the pilot hole-drilling assembly. The motor may drive both bits, or only the pilot bit. A motor drive shaft may extend through the hole-opening bit to the pilot bit.

The pilot bit is of course smaller than the hole-opening bit, and will typically be approximately half the diameter of the hole-opening bit. In general, the pilot bit will cut a hole with an area of less than half the area of the opened hole. The bits may be fixed diameter bits.

The pilot bit may be more aggressive than the hole-opening bit, or otherwise configured to drill more efficiently than the reamer section by providing, for example, improved hydraulics compared to the hole-opening bit. For example, a large proportion of the drilling fluid may be supplied to jetting nozzles in the pilot bit, providing enhanced cooling and cleaning. Also, the relatively high flow rate and pressure of the high velocity fluid jets issuing from the jetting nozzles in the pilot bit may also provide a cutting effect or enhanced cuttings removal. The lower proportion of drilling fluid supplied to the hole-opening bit is alleviated by the fact that the fluid that has exited the jetting nozzles in the pilot bit will flow past the hole-opening bit during its passage to surface. The pilot hole bit will typically experience a disproportionately high hydraulic horsepower per unit area of hole area cut, typically measured in units of hydraulic horsepower per square inch. This is in part due to the ability to transport drilling fluid through a relatively large diameter drill string to a point very close to the pilot hole-drilling assembly.

The pilot bit may be arranged such that the bit is substantially isolated from mechanical weight applied to the body, and may float relative to the body, or to a portion of the pilot hole-drilling assembly. For example, the bit may be mounted on a piston such that the weight experienced by the pilot bit is a function of fluid pressure acting on the piston. Alternatively, or in addition, the bit may be spring-mounted.

The pilot hole-drilling assembly may be provided in combination with an arrangement for vibrating the assembly or for otherwise varying the weight-on-bit experienced by the pilot bit. This is believed to reduce the tendency of a bit to deviate or build. This may be achieved by providing the assembly in combination with a tool such the tool supplied under the AG-itator trade mark by the applicant. Aspects of the operation of this tool are described in applicant's U.S. Pat. Nos. 6,279,670, 6,508,317, and 6,439,318, the disclosures of which are incorporated herein in their entirety.

The pilot hole-drilling assembly may be provided in combination with arrangements to minimise deviation of the pilot hole. For example, if the pilot bit encounters a harder formation the bit may start to take more weight and could tend to "kick-off" and deviate the hole. This effect may be minimised by stabilising the assembly, for example by providing one or more stabilisers on the pilot hole drilling assembly, such as a near bit stabiliser and a first string stabiliser closer to the hole-opening bit. The stabilisers may be full gauge or adjustable. In one embodiment an adjustable near bit stabiliser is provided. Where provided, an adjustable stabiliser may be weight-activated or weight-sensitive, such that an increase in weight experienced by the pilot hole bit will result in the diameter of the stabiliser increasing, to prevent or minimise deviation and maintain the current trajectory. The adjustable stabiliser may be weight actuated, such that an increase in weight automatically increases the diameter described by the stabiliser. The adjustable stabiliser may be biased to normally assume a smaller diameter configuration. This may be achieved by provision of a spring or the like within the stabiliser, or by arranging the stabiliser such that fluid pressure tends to urge the stabiliser to assume a smaller diameter configuration. The stabiliser may provide an operator-detectable indication of its configuration, for example, on assuming the full-gauge configuration the stabiliser may open or close a fluid port, reducing or increasing the back pressure in the drilling fluid seen at surface. In response, the operator may reduce the weight applied to the apparatus, reducing the tendency for the pilot bit to kick-off. In other embodiments, this effect may be achieved automatically, without operator intervention.

In other embodiments the apparatus may include sensors to detect deviation from the desired trajectory, which will typically be vertical, allowing appropriate remedial action, which may require operator intervention or may occur automatically.

According to another aspect of the invention there is provided a drilling apparatus comprising: a body; a pilot hole-drilling assembly mounted to the body for drilling a pilot hole of a first diameter; and a hole-opening assembly mounted to the body for opening the pilot hole to a larger second diameter, the apparatus being configured such that, in use, the pilot hole-drilling assembly acts as a pendulum and tends to assume a vertical orientation.

Pendulum assemblies featuring a single drill bit are known. However the existing arrangements are only capable of drilling relatively slowly, due to the limitations in the weight that may be applied to the assembly while still maintaining the pendulum effect. In embodiments of the present invention, the majority of the work of drilling the hole is done by the hole-opening assembly, which may take the majority of the weight applied to the apparatus, allowing the pilot hole-opening assembly to act as a pendulum despite relatively high weight being applied to the apparatus. It is thus possible to achieve relatively high rates of penetration while still obtaining the benefits of the pendulum effect.

According to a further aspect of the invention there is provided a drilling apparatus comprising: a body; a pilot hole-drilling assembly mounted to the body for drilling a pilot hole of a first diameter; a hole-opening assembly mounted to the body for opening the pilot hole to a larger second diameter; the apparatus being configured such that the pilot hole-drilling assembly experiences less weight on bit (WOB) than the hole-opening assembly.

According to a still further aspect of the present invention there is provided a method of drilling a subterranean bore, the method comprising: providing a drilling apparatus comprising a pilot hole-drilling assembly and a hole-opening assembly on a common support member; drilling a pilot hole of a first diameter; and opening the pilot hole to a larger second diameter, wherein the pilot hole-drilling assembly achieves a rate-of-penetration at a first unit loading and the hole-opening assembly achieves said rate-of-penetration at a second unit loading greater than the first.

According to another aspect of the invention there is provided a method of drilling a subterranean bore, the method comprising: providing a pilot hole-drilling assembly and a hole-opening assembly on a common support; drilling a pilot hole of a first diameter, the pilot hole-drilling assembly acting as a pendulum and tending to assume a vertical orientation; and opening the pilot hole to a larger second diameter.

According to a further aspect of the invention there is provided a method of drilling a subterranean bore, the method comprising: providing a pilot hole-drilling assembly and a hole-opening assembly on a common support; drilling a pilot hole of a first diameter; and opening the pilot hole to a larger second diameter, while applying less weight on bit (WOB) to the pilot hole-drilling assembly than to the hole-opening assembly.

According to a still further aspect of the present invention there is provided a drilling apparatus comprising: a body; a pilot hole-drilling assembly mounted to the body and including an adjustable stabiliser; and a hole-opening assembly mounted to the body for opening the pilot hole to a larger diameter, the arrangement being such that on the pilot hole-drilling assembly experiencing weight above a predetermined level the gauge of the stabiliser increases.

According to a yet further aspect of the present invention there is provided a method of drilling a subterranean bore, the method comprising: providing a drilling apparatus comprising a pilot hole-drilling assembly and a hole-opening assembly, the pilot hole-drilling assembly including an adjustable stabiliser; applying weight to the apparatus; and increasing the gauge of the stabiliser if the weight borne by the pilot hole-drilling assembly reaches a predetermined level.

The adjustable stabiliser may be a full gauge stabiliser, and may be capable of describing a diameter or gauge corresponding to the pilot hole diameter.

The stabiliser may be weight actuated, such that the gauge of the stabiliser increases directly in response to an increase in weight experienced by the stabiliser. The stabiliser may be a mechanical stabiliser.

The various aspects of the invention may be provided in combination with one or more of the optional features described above with reference to the other aspects.

DETAILED DESCRIPTION OF THE DRAWINGS

Figures 1, 2:
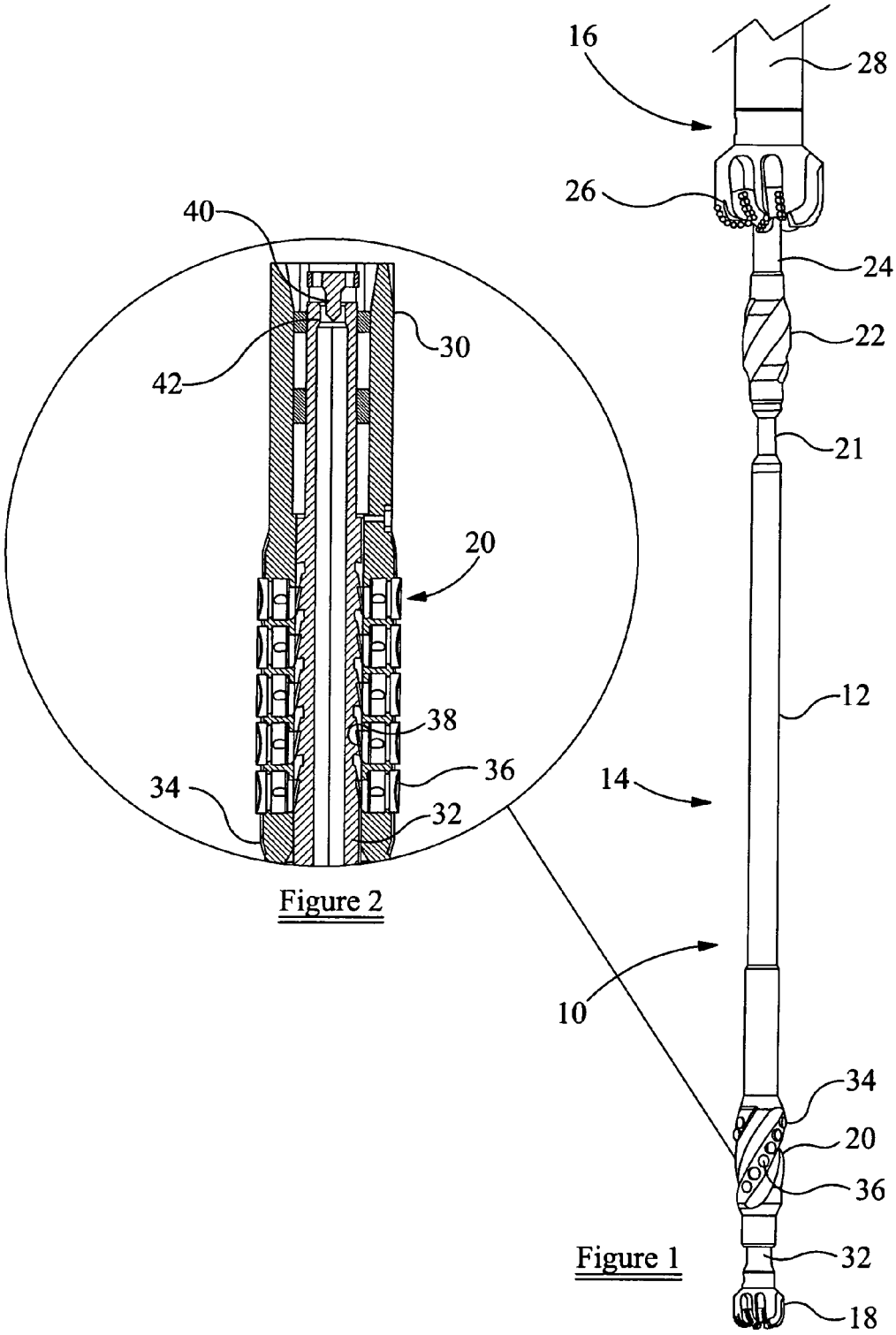
FIG. 1 is a view of drilling apparatus in accordance with a preferred embodiment of the present invention.
FIG. 2 is an enlarged sectional view of a near bit stabiliser of the apparatus of FIG. 1.

Reference is first made to FIG. 1 of the drawings, which illustrates a drilling apparatus 10 in accordance with a preferred embodiment of the present invention, intended for use in the accurate drilling of vertical holes. The apparatus 10 is adapted to be mounted on the distal end of a drill string and comprises a pilot hole drilling bottom hole assembly (BHA) 14 and a hole-opening bottom hole assembly (BHA) 16. In use, the pilot BHA 14 is utilised to drill a pilot hole of a first diameter, and the hole-opening BHA 16 is utilised to open the pilot hole to a larger second diameter. As will be described, the apparatus 10 is configured such that the pilot BHA 14 drills a vertical hole, the hole-opening BHA 16 then opening the hole to the required diameter, and following the path of the pilot hole.

The pilot BHA 14 comprises a pilot drill bit 18 which is mounted below an adjustable near bit stabiliser 20. This lower portion of the pilot BHA 14 incorporates a high density material, for example, tungsten alloy. In this context, a high density material is a material of higher density than carbon steel.

The lower portion of the pilot BHA 14 is mounted on the lower end of a small diameter drill collar 12, at the upper end of which is provided a flex section 21, and above the flex section a full gauge non-adjustable stabiliser 22. The drill collar 12 may accommodate an MWD tool, or sensors which communicate with an MWD tool provided above or forming part of the hole-opening BHA 16. A motor drive shaft 24 extends upwardly from the stabiliser 22, through the hole opener bit 26 into a powerful downhole motor 28: the motor 28 is accommodated in the larger hole section above the hole-opening bit 26, and thus may be large relative to the diameter of the pilot bit 18.

Reference is now also made to FIG. 2 of the drawings, which is a sectional view of the adjustable stabiliser 20. Of course, those of skill in the art will notice that FIG. 2 is a section which follows a helical line. The stabiliser 20 includes an outer body or sleeve 30 which is coupled to the small diameter drill collar 12. The sleeve 30 accommodates a mandrel 32 which provides mounting for the pilot bit 18. The mandrel 32 is splined to the sleeve 30, such that rotation is transferred to the mandrel 32 from the sleeve 30.

The sleeve defines three helical blades 34, each of which accommodates six extendable stabiliser buttons 36. The inner end of each button 36 features a cam face 38 which co-operates with a corresponding cam face on the mandrel 32. The upper end of the mandrel 32 is configured to form a differential piston, such that the fluid pressure created by pumping drilling fluid through the apparatus 10 pushes the mandrel 32 downwards to retain the buttons 36 in a retracted configuration. However, if the pilot bit 18 experiences elevated weight, the mandrel 32 is pushed upwardly relative to the sleeve 30, moving the buttons 36 radially outwards, such that the stabiliser 20 assumes a full gauge configuration, as illustrated in FIG. 2.

The upward movement of the mandrel 32 also locates a sleeve-mounted probe 40 within a mandrel-mounted nozzle 42, which increases the back pressure in the drilling fluid seen at surface, thus providing a readily identifiable indicator of stabiliser configuration, and also an indication of the weight being experienced by the pilot bit 18.

In use, the apparatus 10 is mounted on the lower end of a drill string which is driven from surface. In addition, the pilot BHA 14 is rotated by the downhole motor 28. Accordingly, the pilot BHA 14 is rotated significantly faster than the hole-opening BHA 16, and thus is capable of achieving a given rate-of-penetration (ROP) at a lower unit loading than the hole-opening BHA 16. In other words, the pilot BHA 16 exhibits higher drilling efficiency than the hole-opening BHA. The limiting factor to the ROP achievable using the apparatus is thus the ROP achievable by the hole-opening BHA 16. As a result, the pilot BHA 14 is effectively suspended from the hole-opening BHA 16, and experiences very little or no weight-on-bit (WOB). The pilot BHA 14 therefore acts as a pendulum assembly, and tends to assume a vertical orientation. Thus, gravity keeps the pilot hole vertical, the hole-opening BHA 16 following the vertical pilot hole. Directional drilling issues are thus effectively isolated from the hole-opening BHA 16, the configuration of which may therefore be focussed on effective drilling, and which may also be subject to relatively high weight-on-bit without affecting drilling direction.

In the event of the pilot bit 18 encountering a harder formation, the pilot bit 18 will start to take more weight. Unless counteracted, this could tend to "kick off" and deviate the well. However, if the pilot bit 18 does start taking weight, the additional weight changes the configuration of the adjustable near bit stabiliser 20 to full gauge. The pilot BHA 14 is thus transformed from a pendulum assembly to a holding assembly. This prevents deviation of the hole and maintains the vertical trajectory until either the pilot bit 18 drills through the harder formation into a softer formation, or the hole-opening BHA 16 also encounters the harder formation and slows down. The increase in drilling fluid back pressure seen at surface also alerts the operator to the stabiliser configuration, such that the operator is then alert to the increase in weight on the pilot bit 18. If considered appropriate, the operator may reduce the weight being applied to the apparatus 10, or such a weight reduction may occur automatically.

Thus, the above-described apparatus 10 provides a relatively simple mechanical system which facilitates accurate drilling of vertical holes. The apparatus may be utilised to initiate and drill a vertical hole, or may be utilised to bring an inclined hole section to a vertical orientation. In both cases, the apparatus will replace relatively complex and expensive tools.

As noted above, a number of advantage accrue from the availability of a relatively large bore above the relatively short pilot hole, such as the ability to transport drilling fluid at a relatively high flow rate to the cutting area, and the ability to accommodate relatively large motors and other tools above the pilot hole. For example, a 6 inch diameter pilot bit may be provided below a 12½ inch diameter hole-opening bit, allowing provision of an 8-9⅝ inch motor for driving the pilot bit.

It will be apparent to those of skill in the art that the above-described and illustrated embodiment is merely exemplary of the present invention, and that various modifications and improvements may be made thereto without departing from the scope of the present invention. For example, a tool for inducing vibration or movement of a BHA, such as the tool supplied by the Applicant under the AG-itator trade mark, may be incorporated in the pilot BHA 14 to ensure that the pilot bit 18 drills with less weight-on-bit, and the action of the AG-itator tool would also tend to reduce build tendencies, because of the vibrating action the tool induces in low weight-on-bit applications. In other embodiments, different numbers or configurations of stabilisers may be provided.

In the above-described embodiment, the weight-on-bit at the pilot bit 18 is identified as being low. However, it is believed the desired effect of maintaining a near-vertical bore may still be achieved with relatively high weight-on-bit, as long as some portion of the pilot BHA 14 is in tension. Thus, the pilot BHA 14 is suspended from the drill string, and conveniently suspended from the hole-opening BHA 16, such that the weight-on-bit at the pilot bit 18 is less than the weight of the pilot BHA 14, and the pilot BHA 14 will tend towards a vertical orientation. This effect will be accentuated by locating the centre-of-gravity of the pilot BHA 14 as low as possible, and by locating the flexible portion of the pilot BHA 21 at or above the neutral point on the assembly 14 where the compressive and tensile forces are in balance. Of course the weight-on-bit at the hole-opening bit 26 may be substantially higher, and suspending the pilot BHA 14 from the hole-opening BHA 16 serves to increase the weight-on-bit on the hole-opening bit 26. Thus it is possible to achieve a pendulum effect while still providing high weight-on-bit at both the hole-opening bit 26 and the pilot bit 18, and achieving a high rate-of-penetration.

Apparatus in accordance with aspects of the present invention may be manufactured and supplied in any combination of sizes, and a noted above it may be convenient to provide a pilot bit approximately half the diameter of the hole-opening bit. However, it may be convenient to provide a standard pilot hole-drilling assembly for use with a number of different sizes of hole-opening assemblies. This simplifies manufacture and supply, and also may permit an operator to use a single pilot hole-drilling assembly with a number of different hole-opening assemblies during the drilling of a well.

Embodiments of the invention may be utilised in drilling vertical sections of subterranean bores, typically the initial section of a bore. Directional drilling techniques may be used subsequently to introduce changes in the bore inclination or azimuth. However, the invention may also be utilised where it is desired to turn an inclined bore towards a vertical inclination.

The invention claimed is:

1. A drilling apparatus comprising:
a hole-opening assembly comprising:
a hole-opening bit; and
a pilot-hole drilling assembly comprising a pilot bit mounted on a drill support such that while the pilot bit drills a pilot hole of a first diameter and the hole-opening bit opens the pilot hole to a larger second diameter the pilot bit is suspended from the drill support and hangs from the hole opening body such that the pilot bit is isolated from mechanical weight applied to the hole opening bit.

2. The drilling apparatus of claim 1, wherein a portion of the drill support arranged to be in tension is located below the hole-opening bit.

3. The drilling apparatus of claim 1, wherein a portion of the drill support located below the hole-opening bit comprises a flexible part whereby the pilot bit will tend to hang towards a vertical orientation.

4. The apparatus of claim 1, wherein the pilot hole-drilling assembly comprises at least one stabilizer.

5. The apparatus of claim 4, wherein at least one stabilizer is adjustable.

6. The apparatus of claim 5, wherein the adjustable stabilizer is weight-sensitive, such that an increase in weight experienced by the pilot hole-drilling assembly causes the diameter of the stabilizer to increase.

7. The apparatus of claim 5, wherein the adjustable stabilizer is configured to normally assume a smaller diameter configuration.

8. The apparatus of claim 7, wherein the adjustable stabilizer is configured to provide an operator-detectable indication of stabilizer configuration.

9. The apparatus of claim 4, wherein at least one stabilizer is full gauge.

10. The apparatus of claim 1, wherein the pilot hole-drilling assembly is adapted to experience relatively low weight on bit.

11. The apparatus of claim 1, wherein the pilot hole-drilling assembly is adapted to assume a vertical orientation under the influence of gravity.

12. The apparatus of claim 1, wherein the apparatus is configured such that the pilot bit is adapted to be driven at a faster rate than the hole-opening bit.

13. The apparatus of claim 12 wherein the pilot bit is adapted to be driven by a downhole motor.

14. The apparatus of claim 13, comprising a downhole motor.

15. The apparatus of claim 14, wherein the motor drives both the pilot bit and the hole-opening bit.

16. The apparatus of claim 1, wherein the pilot bit is configured to cut a hole with an area of less than half the area of the opened hole.

17. The apparatus of claim 1, wherein the apparatus is configured such that the volumetric rate of drilling fluid per unit cutting area supplied to the pilot hole-drilling assembly is a first rate and the volumetric rate of drilling fluid per unit cutting area supplied to the hole opening assembly is less than said first rate.

18. The apparatus of claim 1, wherein the hole-opening assembly is adapted to remove a greater volume of material than the pilot hole drilling assembly.

19. A method of drilling a subterranean bore, the method comprising:

providing a pilot bit and a hole-opening assembly on a drilling support;

drilling a pilot hole using the pilot bit;

opening the pilot hole using a hole-opening bit with the pilot bit suspended from the drilling support while hanging the pilot bit from the hole opening body such that the pilot bit is isolated from the mechanical weight applied to the hole opening bit.

20. A drilling apparatus comprising: a body;

a pilot hole-drilling assembly mounted to the body and comprising an adjustable stabilizer; and a hole-opening assembly mounted to the body for opening the pilot hole to a larger diameter, the arrangement being such that on the pilot hole-drilling assembly experiencing weight above a predetermined level the gauge of the stabilizer increases.

* * * * *